US006394468B1

(12) United States Patent
Chiang et al.

(10) Patent No.: US 6,394,468 B1
(45) Date of Patent: May 28, 2002

(54) DUAL-PURPOSE SHOE

(76) Inventors: Kuo-Pin Chiang, No. 30-5, Sheling, Yuanli Jen; Chia-Yi Cheng, No. 27, Lane 35, Nan Hua Rd., Tung Hsiao Jen, both of Miaoli Hsien (TW)

( * ) Notice: Subject to any disclaimer, the term of this patent is extended or adjusted under 35 U.S.C. 154(b) by 0 days.

(21) Appl. No.: 09/846,215

(22) Filed: May 2, 2001

(51) Int. Cl.[7] ..... A63C 17/20
(52) U.S. Cl. ..... 280/11.223; 280/11.27
(58) Field of Search ..... 280/7.12, 7.13, 280/7.14, 11.19, 11.221, 11.223, 11.231, 11.25, 11.27

(56) References Cited

U.S. PATENT DOCUMENTS 3,884,485 A * 5/1975 Walle ..... 280/841
5,398,970 A * 3/1995 Tucky ..... 280/11.19
6,120,039 A * 9/2000 Clementi ..... 280/11.19
6,247,708 B1 * 6/2001 Hsu ..... 280/11.223
6,270,095 B1 * 8/2001 Chang ..... 280/87.041
6,308,964 B1 * 10/2001 Chang ..... 280/11.19
6,328,318 B1 * 12/2001 Hsu ..... 280/11.223

FOREIGN PATENT DOCUMENTS

EP 1086727 A1 * 3/1999

* cited by examiner

*Primary Examiner*—Christopher P. Schwartz
*Assistant Examiner*—Xuan Lan Nguyen

(57) ABSTRACT

A dual-purpose includes an outsole having increased thickness for forming two open-bottomed cavities. In each of the cavities, there is mounted a wheel assembly that includes a fixing bracket screwed to a top of the cavity, a wheel holder movably mounted in the fixing bracket, a wheel rotatably supported on the wheel holder, and a pair of control plates fixed at two sides of the fixing bracket to connect at an end to the wheel holder. The control plates of each of the wheel assemblies mounted in the cavity are connected to an external knob. Turning the knob clockwise or counterclockwise causes the control plates to pivotally turn and thereby bring the wheel holder to move upward or downward in the fixing bracket. When all the wheel holders are moved upward, the wheels retract into the cavities and the shoe functions like an ordinary shoe, and when the wheel holders are moved downward, the wheels expose from the cavities and the shoe functions like a roller skate.

4 Claims, 6 Drawing Sheets

DUAL-PURPOSE SHOE

BACKGROUND OF THE INVENTION

The present invention relates to a dual-purpose shoe, and more particularly to a shoe having wheel assemblies retractably mounted to an outsole of the shoe, so that the shoe functions like a roller skate when wheels of the wheel assemblies are exposed from the outsole.

There are various types of skates available in the markets, such as four-wheeled roller skates, in-line roller skates, hockey skates, etc. All these skates are designed only for one purpose, that is, skating, and are not suitable for wearing to talk. To go to a skating rink, a skater has to wear ordinary shoes and brings a pair of skates along with him or her. After skating, the skater has to change the shoes to the ordinary ones and bring the pair of skates home. It is naturally very troublesome for the skater to do so.

In recent years, the skates, particularly roller skates, are found very useful in large-scaled shopping malls. Workers of the shopping malls often need to move from place to place in the same and different floors to check and supply goods on shelves. By wearing roller skates or in-line skates, these workers are able to move around on floors quickly and effortlessly. However, it is very danger to move up and down stairs and on rough surfaces when wearing these roller or in-line skates. They even endanger the wearers at such places by causing falls and sprained ankles.

SUMMARY OF THE INVENTION

It is therefore a primary object of the present invention to provide a dual-purpose shoe that can be easily changed between two modes at any time to function either as an ordinary shoe suitable for walking or as a roller skate suitable for moving smoothly and effortlessly at increased speed, simply depending on the wearer's actual needs.

To achieve the above and other objects, the dual-purpose shoe of the present invention mainly includes an outsole having increased thickness for forming two open-bottomed cavities. In each of the cavities, there is mounted a wheel assembly that includes a fixing bracket screwed to a top of the cavity, a wheel holder movably mounted in the fixing bracket, a wheel rotatably supported on the wheel holder, arid a pair of control plates fixed to two sides of the fixing bracket to connect at an end to the wheel holder. The control plates of each of the wheel assemblies mounted in the cavity are connected to an external knob. Turning the knob clockwise or counterclockwise causes the control plates to pivotally turn and thereby bring the wheel holder to move upward or downward in the fixing bracket. When all the wheel holders of one shoe are moved upward, the wheels retract into the cavities and the shoe functions like an ordinary shoe, and when the wheel holders are moved downward, the wheels expose from the cavities and the shoe functions like a roller skate.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 4:
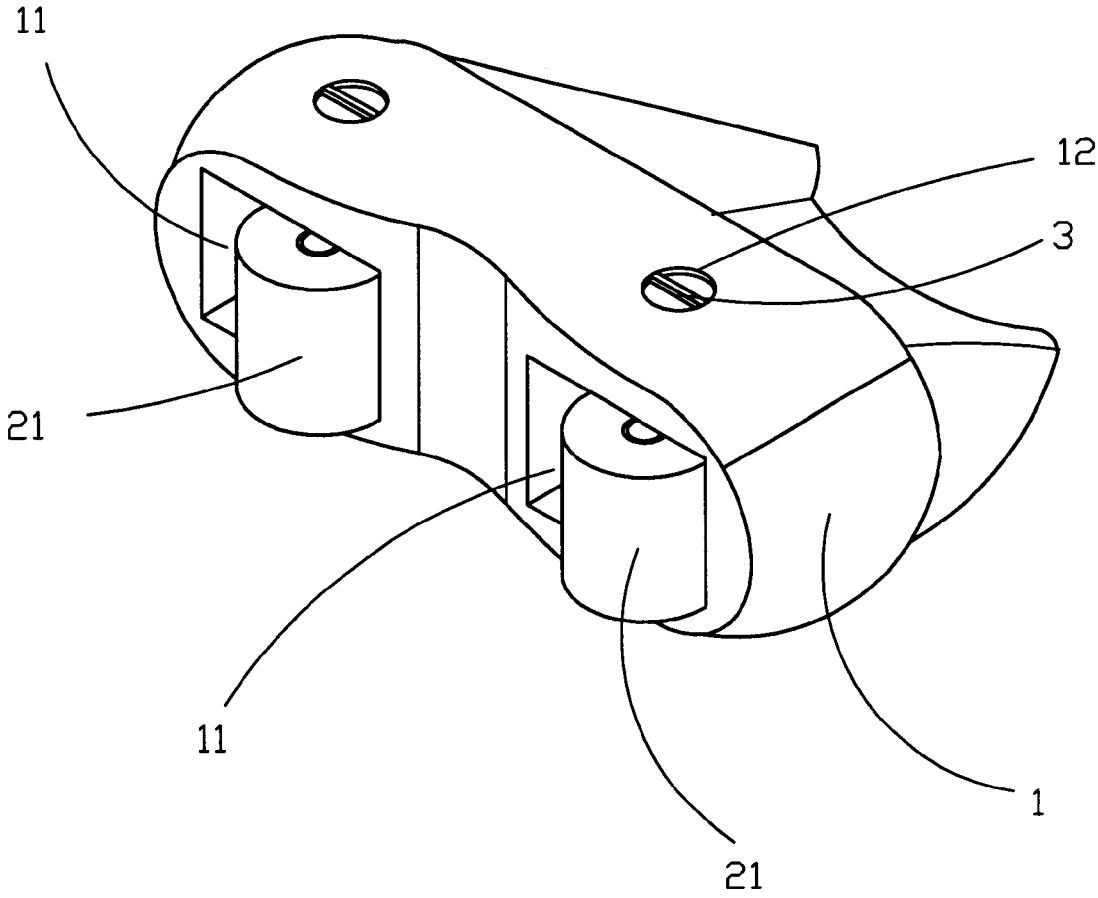
FIG. 4 is a bottom perspective view of a dual-purpose shoe of the present invention with two wheels thereof exposed from the outsole of the shoe.
Figure 5:
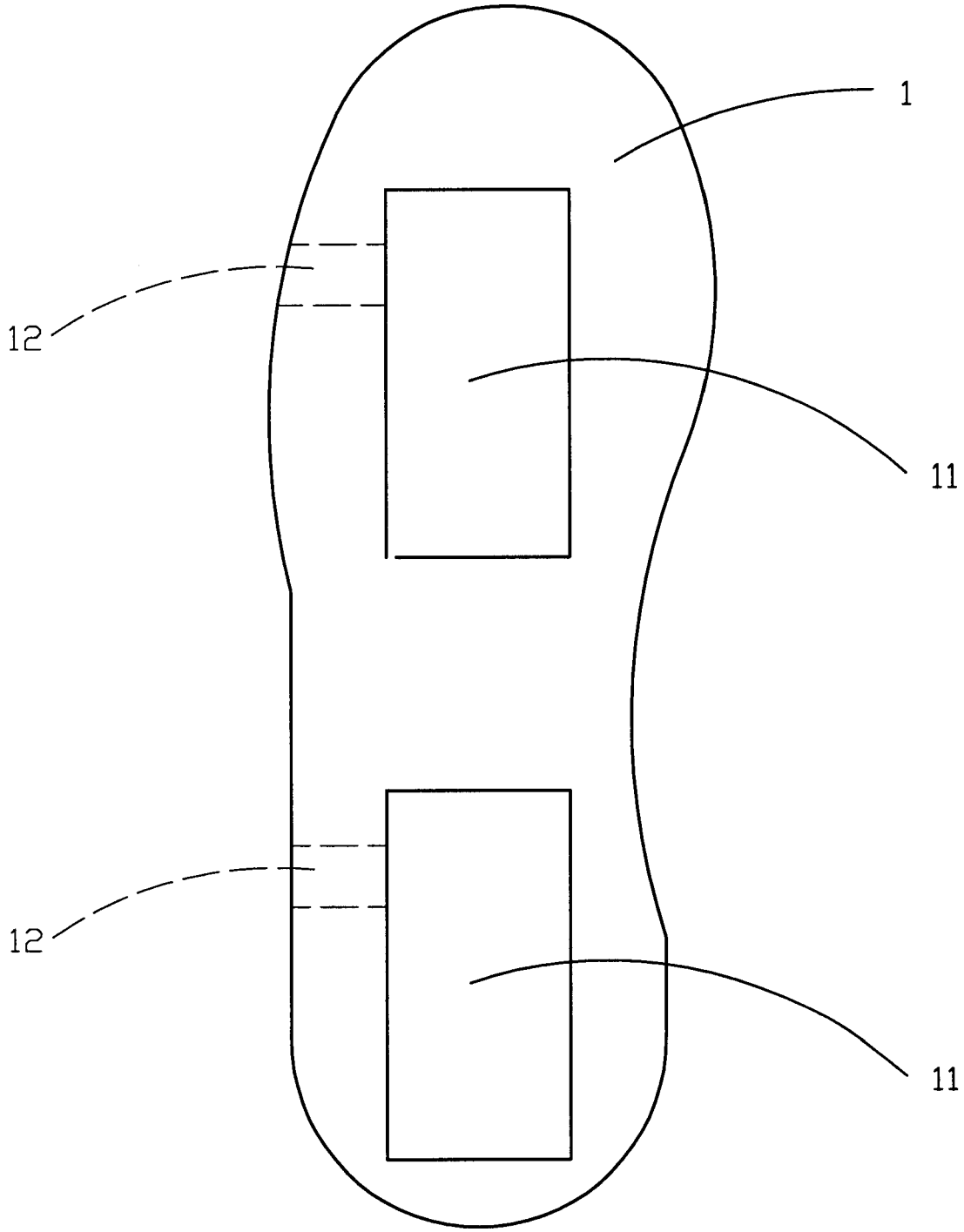
FIG. 5 is a bottom plan view of the dual-purpose shoe of FIG. 4.
Figure 7:
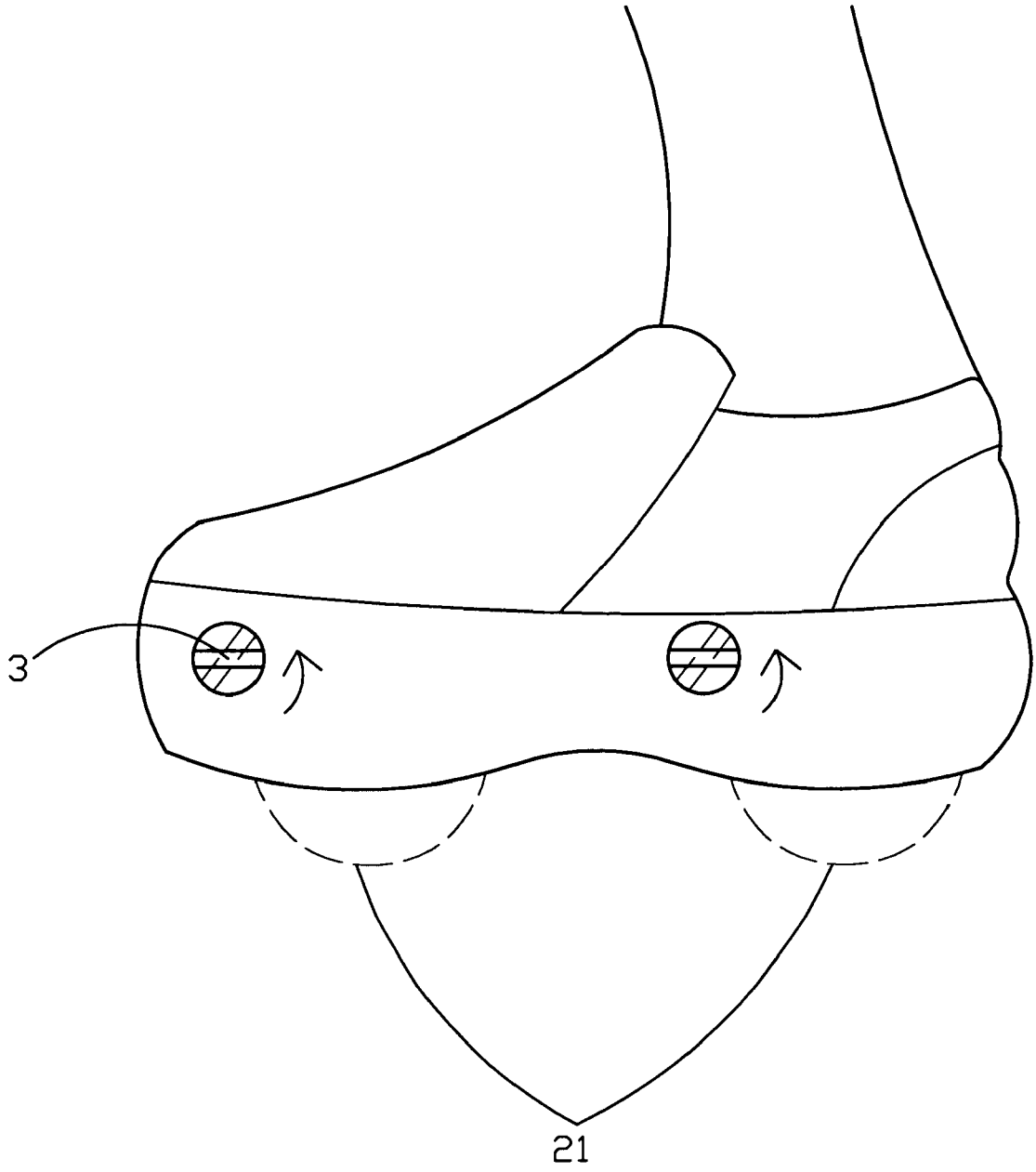
FIG. 7 schematically shows th e dual-purpose shoe of the present invention in use.

Please refer to FIGS. 4, 5 and 7 in which a dual-purpose shoe according to the present invention is shown. The dual-purpose shoe includes an outsole 1 having an increased thickness and being provided at front and rear end portions of the outsole 1 with two open-bottomed cavities 11, in each of which a wheel assembly 2 is mounted. The outsole 1 is also provided at one lateral side corresponding to the cavities 11 with two through holes 12 to communicate internal spaces of the two cavities 11 with a space outside the outsole 1. Each of the two through holes 12 has a knob 3 mounted therein for manipulating the wheel assembly 2 mounted in the corresponding cavity 11, in order to move a wheel 21 of the wheel assembly 2 between two positions, namely, an extended position and a retracted position. The wheels 21 in the extended position are partially downward exposed from the cavities 11, enabling the shoe to function like a roller skate; and the wheels 21 in the retracted position are completely received in the cavities 11, enabling the shoe to function like an ordinary shoe suitable for walking.

Figure 1:
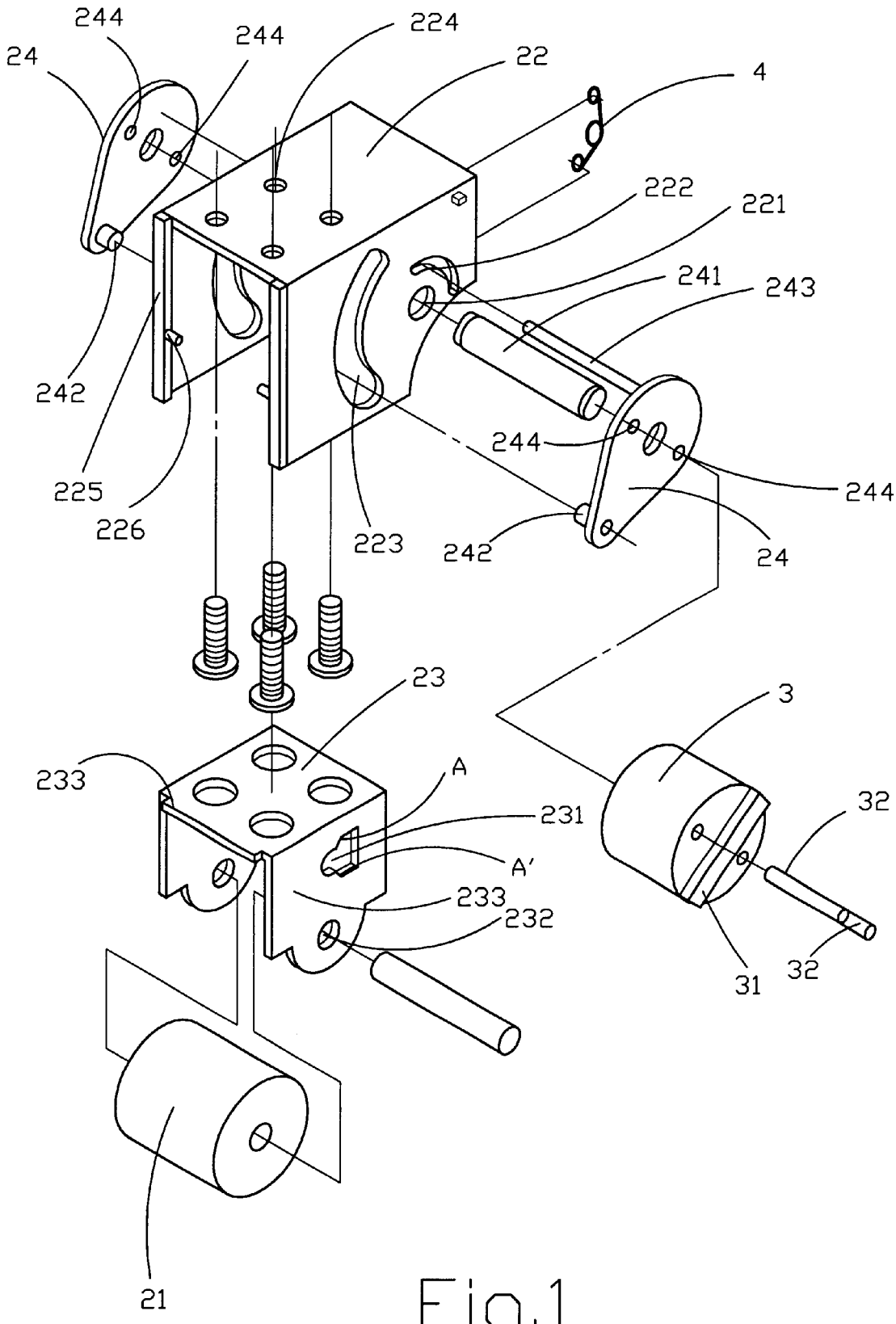
FIG. 1 is an exploded perspective of a wheel assembly for the dual-purpose shoe of the present invention.
Figure 2:
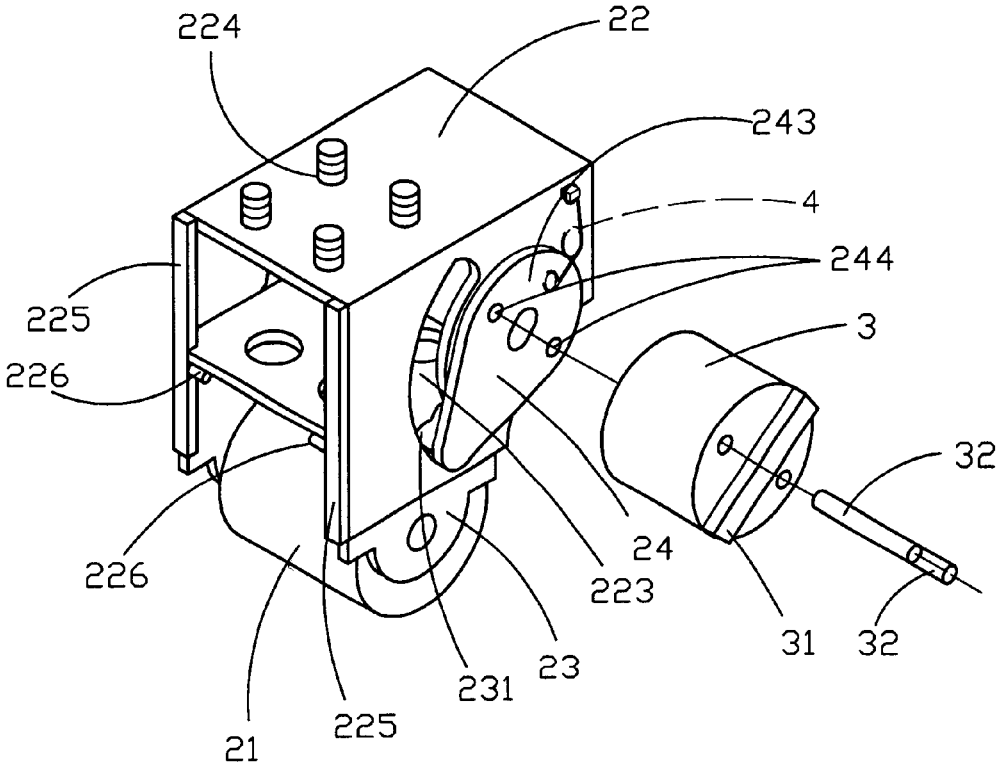
FIG. 2 is an assembled perspective of the wheel assembly of FIG. 1, wherein a knob has not yet been connected to the wheel assembly.
Figure 3:
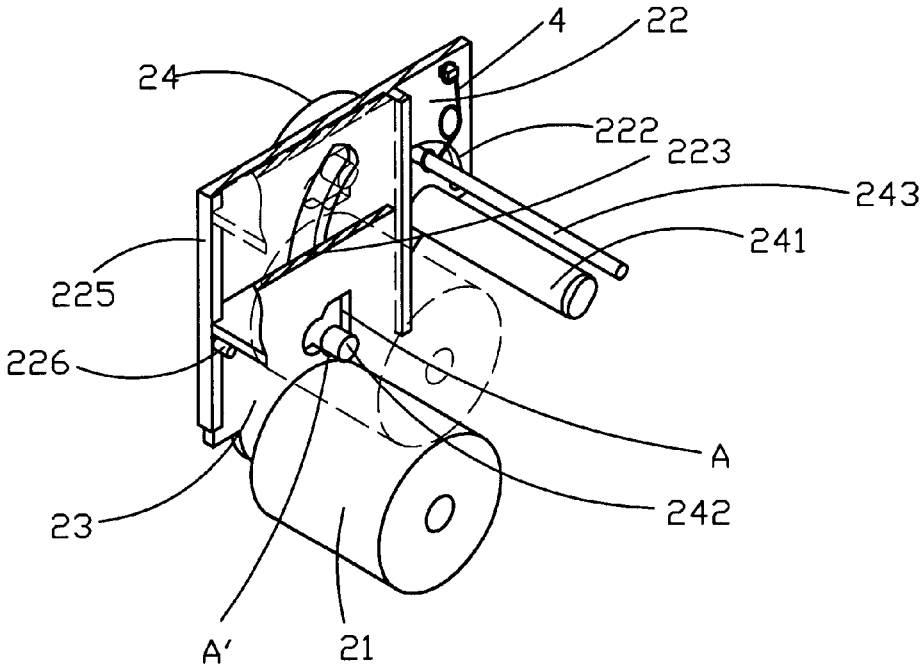
FIG. 3 is a partially cutaway perspective of the wheel assembly of FIG. 2 showing an internal structure thereof.

Please refer to FIGS. 1, 2 and 3 at the same time. Each of the wheel assemblies 2 mainly includes a wheel 21, a fixing bracket 22, a wheel holder 23, and two control plates 24.

The fixing bracket 22 is an n-shaped member having two side walls and a top to define a front, a rear, and a bottom opening. The two sidewalls are symmetrically provided at predetermined positions with a round shaft hole 221, a curved slot 222 behind the shaft hole 221, and a guide slot 223 in front of the shaft hole 221, and the top is provided with a number of mounting holes 224. The front opening of the fixing bracket 22 is provided at two vertical sides with two stoppers 225 that are provided at predetermined positions with two pins 226 to face each other.

The wheel holder 23 is also an n-shaped member having two side walls and a top to define a front, a rear, and a bottom opening, and is sized for locating in the fixing bracket 22. The top of the wheel holder 23 has a front edge horizontally projected forward by a predetermined length to form an extension 233. The two side walls of the wheel holder 23 are symmetrically provided at predetermined positions with a limiting hole 231 and an axle hole 232 below the limiting hole 231. The limiting hole 231 is so shaped that an upward and a downward extended curved edge A and A', respectively, are formed at a rear part of the limiting hole 231.

The two control plates 24 are fixedly connected to two ends of a shaft 241 that is extended across the fixing bracket 22 via the two round shaft holes 221 on the two side walls of the fixing bracket 22 to outward project two ends from the side walls. Each of the two control plates 24 is provided at an inner side of a front end with an inward projected bar 242, and at predetermined positions at a second end with two retaining holes 244. Moreover, one of the two control plates 24 is provided at an inner side of the second end with a perpendicularly projected slide bar 243.

In each of the wheel assemblies 2, the wheel 21 is rotatably supported in the wheel holder 23 on an axle extended through the axle holes 232, and the wheel holder 23 is movably mounted in the fixing bracket 22 with the front extension 233 located between the two stoppers 225 of the fixing bracket 22 and above the two pins 226. The two control plates 24 are connected to two ends of the shaft 241 with the two bars 242 inward extended through the guide slots 223 on the fixing bracket 22 and the limiting holes 231 on the wheel holder 23 to hold the wheel holder 23 in the fixing bracket 22. Meanwhile, the slide bar 243 provided on one of the two control plates 24 is extended through the two curved slots 222.

The knob 3 is a cylindrical member fitted into the through hole 12 from outside of the outsole 1, so that a grip portion 31 provided at one outer end of the knob 3 is exposed from the outsole 1 and two long pins 32 axially extended through the knob 3 to project from an inner end of the knob 3 are engaged with the two retaining holes 244 on one of the two control plates 24 closer to the knob 3. Thereby, turning of the knob 3 at the grip portion 31 clockwise or counterclockwise causes the first end of the control plates 24 to pivotally move upward or downward. At this point, the bar s 242 located at the first end of the control plates 24 and extended into the limiting holes 231 of the wheel holder 23 move upward and downward in the guide slots 223 and bring the wheel holder 23 to move upward or downward along with them.

Figure 6:
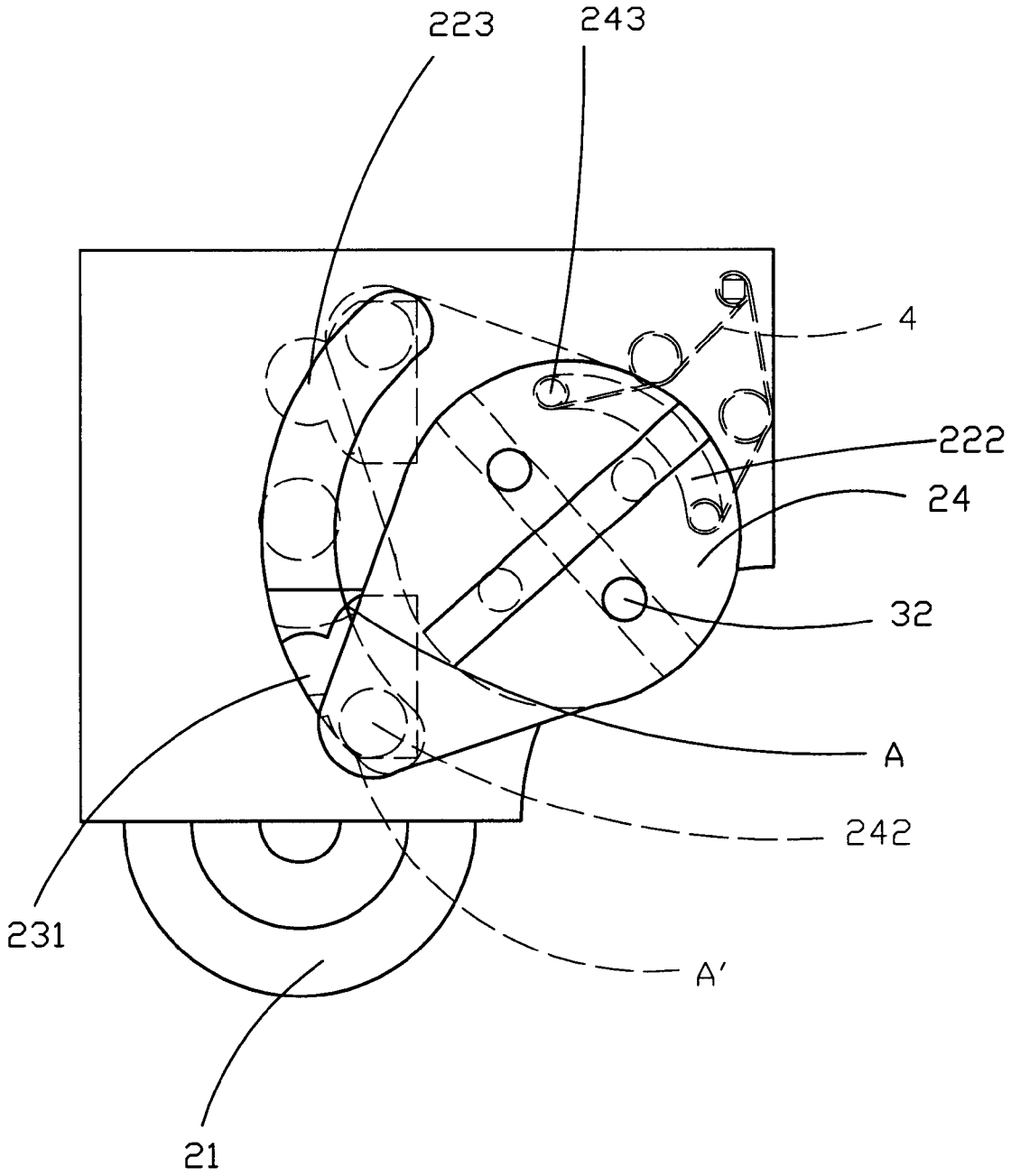
FIG. 6 shows two control plates of the wheel assembly is turned via the knob to a lower dead point to expose the wheel.

FIG. 6 illustrates in details the manner in which the wheel 21 in the wheel assembly 2 is retracted into and expose d from the cavity 11 via turning the knob 3.

When a user intends to change the dual-purpose shoe from an ordinary shoe into a roller skate, he or she may put down the wheels 21 by turning the knobs 3 counterclockwise one by one. When a knob 3 is turned counterclockwise, the two long pins 32 of the knob 3 engaged with the retaining holes 244 at the second end of the control plate 24 cause the two control plates 24 to rotate about the shaft 241 counterclockwise, bringing the bars 242 at the first end of the control plates 24 to shift out of the upward extended curved edges A, that are upper dead points of the limiting holes 231, and bring the wheel holder 23 to move downward until the front extension 233 of the wheel holder 23 touches the pins 226 and the wheel holder 23 is prevented from moving down any further. At this point, the bars 242 are located in the downward extended curved edges A', that are lower dead points of the limiting holes 231. With the bars 242 of the control plates 24 pressing against the lower dead points A', the wheel holder 23 is in a vertically unmovable position and would not move upward into the fixing bracket 22 even the wheel 21 is subjected to an upward force, as shown in FIG. 6.

On the other hand, when the user intends to change the dual-purpose shoes from a roller skate into an ordinary shoe, he or she may retract the wheels 21 by turning the knobs 3 clockwise one by one. When the knob 3 is turned clockwise, the two long pins 32 of the knob 3 engaged with the retaining holes 244 at the second end of the control plate 24 cause the two control plates 24 to rotate about the shaft 241 clockwise, bringing the bars 242 at the first end of the control plates 24 to angularly move upward and easily shift out of the downward extended curved edges A'. That is, the heel holder 23 is no longer restricted in the vertically unmovable state and is brought by the bars 242 to move upward. When the bars 242 are shifted into the upward extended curved edges A of the limiting holes 231 while moving upward, the wheel holder 23 is in a vertically unmovable position again and would not move downward to expose from the cavity 11 when the user walks.

For the knob 3 to be easily and smoothly turned with reduced effort, a torsion spring 4 is connected at one end to an inner surface of one side wall of the fixing bracket 22 and at another end to the slide bar 243 of the control plate 24. The torsion spring 4 provides an auxiliary power for the slide bar 243 to move in the curved slot 22, allowing the knob 3 to be turned more smoothly. Moreover, the torsion spring 4 also assists in smooth moving upward or downward of the wheel holder 23.

What is claimed is:

1. A dual-purpose shoe comprising an outsole having an increased thickness and being provided at front and rear end portions with two open-bottomed cavities, in each of which a wheel assembly is mounted, said outsole also being provided at one lateral side corresponding to said cavities with two through holes to communicate internal spaces of said two cavities with a space outside said outsole, each of said two through holes having a knob mounted therein for manipulating said wheel assembly mounted in said cavity corresponding to said through hole, in order to move a wheel of said wheel assembly between two positions, namely, an extended position and a retracted position; said wheels in said extended position being partially downward exposed from said cavities, enabling said shoe to function like a roller skate; and said wheels in said retracted position being completely received in said cavities, enabling said shoe to function like an ordinary shoe suitable for walking;

each of said wheel assemblies mainly including a wheel, a fixing bracket, a wheel holder, and two control plates;

said fixing bracket in each said wheel assembly having two side walls and a top to define a front, a rear, and a bottom opening, said two side walls being symmetrically provided at predetermined positions with a curved slot and a guide slot, and said top being provided with a number of mounting holes, said front opening being provided at two vertical sides with two stoppers that are provided at predetermined positions with two pins to face each other;

said wheel holder in each said wheel assembly also having two side walls and a top to define a front, a rear, and a bottom opening, and being sized for locating in said fixing bracket, said top having a front edge horizontally projected forward by a predetermined length to form an extension, said two side walls being symmetrically provided at predetermined positions with a limiting hole and an axle hole, and said limiting hole being so shaped that an upward and a downward extended curved edge are formed at a rear part of said limiting hole; said wheel holder being movably mounted in said fixing bracket with said front extension located between said two vertical stoppers and above said two pins of said fixing bracket, and said wheel being rotatably supported in said wheel holder on an axle extended through said axle holes;

said two control plates in each said wheel assembly being fixedly connected to two ends of a shaft that is extended across said fixing bracket to project two ends from said two side walls of said fixing bracket, each of said two control plates being provided at an inner side of a first end with an inward projected bar, and at predetermined positions at a second end with two retaining holes; said inward projected bars of said control plates inward extending through said guide slots on said fixing bracket and said limiting holes on said wheel holder, so that said wheel holder is held in said fixing bracket by said bars; and each of said knobs being a cylindrical member having a grip portion provided at one outer end thereof and two long pins axially projected from an inner end of said knob; said knob being fitted in said through hole provided at one lateral side of said outsole with said grip portion exposed to outside and said two long pins engaged with said two retaining holes on said control plate closer to said knob;

whereby when said knob is turned at said grip portion clockwise or counterclockwise, said control plates are caused to pivotally turn about said shaft and bring said bars at the first end thereof and accordingly said wheel holder supported on said bars to move upward or downward, enabling said wheel supported on said wheel holder to move into said retracted position or said extended position.

2. The dual-purpose shoe as claimed in claim 1, wherein each of said fixing brackets is symmetrically provided on said two side walls at predetermined positions with two curved slots.

3. The dual-purpose shoe as claimed in claim 2, wherein one of said two control plates of each said wheel assembly is provided at an inner side with a slide bar corresponding to said curved slots on said fixing bracket, so that said slide bar extends into said curved slots to move therein when said control plates are pivotally turned about said shaft.

4. The dual-purpose shoe as claimed in claim 3, wherein each of said fixing brackets includes a torsion spring, an end of which being connected to an inner side of one of said two side walls of said fixing bracket and another end thereof being connected to said slide bar.

* * * * *